US011557161B2

(12) United States Patent
Lingala et al.

(10) Patent No.: US 11,557,161 B2
(45) Date of Patent: Jan. 17, 2023

(54) METHOD AND A SYSTEM FOR PROVIDING SECURITY TO PREMISES

(71) Applicant: Carrier Corporation, Palm Beach Gardens, FL (US)

(72) Inventors: Ramesh Lingala, Telangana (IN); Adam Kuenzi, Silverton, OR (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 125 days.

(21) Appl. No.: 17/132,926

(22) Filed: Dec. 23, 2020

(65) Prior Publication Data

US 2021/0201611 A1 Jul. 1, 2021

(30) Foreign Application Priority Data

Dec. 26, 2019 (IN) ..... 201911053964

(51) Int. Cl.

| | |
|---|---|
| ***G07C 9/23*** | (2020.01) |
| ***G08B 25/10*** | (2006.01) |
| ***G07C 9/27*** | (2020.01) |
| ***G07C 9/28*** | (2020.01) |
| ***G07C 9/20*** | (2020.01) |

(52) U.S. Cl.
CPC ..... *G07C 9/23* (2020.01); *G08B 25/10* (2013.01)

(58) Field of Classification Search
CPC ..... G07C 9/23
See application file for complete search history.

(56) References Cited

U.S. PATENT DOCUMENTS

| | | | | |
|---|---|---|---|---|
| 2015/0287301 | A1* | 10/2015 | Locke | G01S 5/02 348/156 |
| 2015/0317841 | A1* | 11/2015 | Karsch | G06V 20/52 348/149 |
| 2016/0285950 | A1* | 9/2016 | Lang | G07C 9/27 |
| 2017/0124836 | A1* | 5/2017 | Chung | G08B 25/016 |
| 2017/0295180 | A1* | 10/2017 | Day | H04L 63/10 |

* cited by examiner

*Primary Examiner* — Joseph H Feild
*Assistant Examiner* — Pameshanand Mahase
(74) *Attorney, Agent, or Firm* — Cantor Colburn LLP

(57) ABSTRACT

A system and a method for providing security to premises. A method includes receiving first access information from an accessing unit associated with a premises on accessing the premises by a first user and second access information from a sensing unit associated with the premises on sensing access of the premises by a second user. The method further includes determining correlation between the first access information and the second access information and transmitting a message based on the correlation.

20 Claims, 5 Drawing Sheets

METHOD AND A SYSTEM FOR PROVIDING SECURITY TO PREMISES

FOREIGN PRIORITY

This application claims priority to Indian Patent Application No. 201911053964, filed Dec. 26, 2019, and all the benefits accruing therefrom under 35 U.S.C. § 119, the contents of which in its entirety are herein incorporated by reference.

TECHNICAL FIELD OF INVENTION

The present invention generally relates to security. More particularly, the invention relates to a system and a method for providing enhanced security to a premises.

BACKGROUND OF THE INVENTION

Commercial places, residential places, storage units or any premises are used to store a variety of items such as automobiles, ornaments, pharmaceutical goods or any such items. Typically, items stored in commercial places are accessed lesser number of times (may be once in a week or a month) as compared to items stored in residential places. Thereby, the number of visits to access items stored in commercial places would also be less frequent.

The premises may be locked using a lock in order to secure the items stored inside. These items can only be accessed by an authorized person (may be an owner of the item) who has the authority to access the premises. However, the lock of the premises can be broken by a thief or a burglar in order to steal the items taking advantage of the less frequent access to the premises. This poses a huge risk for the items stored inside the premises. A few security personnel/s may be guarding the premises to safe-guard the items stored inside. However, a thief may impersonate as an authorized person or may harm the security personnel/s to steal the items. Therefore, such solutions do not ensure proper security of the items stored inside the premises.

In view of the afore-mentioned problems in the existing solutions, there is a need of an efficient and effective system and a method for providing proper security of items stored inside a premises. There is a requirement to prevent theft of items stored inside the premises. There is also a need to provide a strong solution to authenticate a person accessing the premises. In order to solve the problems in the existing solutions, a system and a method are disclosed.

SUMMARY OF THE INVENTION

Various embodiments of the invention describe a system for providing security to a premises. The system comprises an accessing unit associated with a premises, a sensing unit associated with the premises and a server. The accessing unit comprises a validation unit adapted to validate credentials of a first user for providing access inside the premises to the first user. A transmitter is adapted to transmit first access information to a server based on the validation of the credentials. Further, the sensing unit is adapted to sense access of the premises by a second user and adapted to transmit second access information to the server based on the sensing. The server comprises a receiver adapted to receive the first access information from the accessing unit associated with the premises and the second access information from the sensing unit associated with the premises and a correlation unit adapted to determine correlation between the first access information and the second access information. The server also comprises a transmitter adapted to transmit a message based on the correlation.

In an embodiment of the invention, the first user and the second user are the same users if the first access information and the second access information are correlated, wherein the first user and the second user are different users if the first access information and the second access information are not correlated.

In a different embodiment of the invention, the first access information and the second access information are derived independently.

In an embodiment of the invention, each of the first access information and the second access information correspond to a time stamp when the premises is accessed.

In another embodiment of the invention, each of the first access information and the second access information correspond to an identifier received by the accessing unit and/or by the sensing unit.

In yet another embodiment of the invention, the first access information and the second access information are correlated with each other when the time stamp associated with the first access information and the time stamp associated with the second access information fall within a pre-defined time limit, wherein the first access information and the second access information are not correlated with each other when the time stamp associated with the first access information and the time stamp associated with the second access information do not fall within a pre-defined time limit.

In another embodiment of the invention, the accessing unit receives the credentials from the first user or a user device of the first user.

In yet another embodiment of the invention, the server receives an indication from a camera, the accessing unit, the sensing unit and/or a user device when the first user and/or the second user exits the premises. Also, after receiving the indication, the server provides a command to the accessing unit and the sensing unit for determining correlation when a new user accesses the premises.

In still another embodiment of the invention, the accessing unit transmits the first access information and/or the sensing unit transmits the second access information to the server using a Wi-Fi network, a mesh network, a bluetooth network, or a cellular network.

In a different embodiment of the invention, the message is a confirmation message transmitted by the server to the accessing unit and/or the sensing unit when the first access information and the second access information are correlated with each other, wherein the message is an alarm message transmitted by the server to the accessing unit and/or the sensing unit when the first access information and the second access information are not correlated with each other.

In a different embodiment of the invention, the sensing unit is adapted to trigger an alarm or provide a notification to a central service when the sensing unit receive the alarm message from the server, wherein the sensing unit is adapted to transmit a signal to a camera to initiate recording when the sensing unit receives the alarm message from the server.

Various embodiments of the invention describe a method for providing security to a premises. The method comprises steps of receiving first access information from an accessing unit associated with a premises on accessing the premises by a first user and receiving second access information from a sensing unit associated with the premises on sensing access of the premises by a second user. The method further comprises steps of determining correlation between the first access information and the second access information and transmitting a message based on the correlation.

In an embodiment of the invention, the first user and the second user are the same users if the first access information and the second access information are correlated, wherein the first user and the second user are different users if the first access information and the second access information are not correlated.

In a different embodiment of the invention, the first access information and the second access information are derived independently.

In an embodiment of the invention, each of the first access information and the second access information correspond to a time stamp when the premises is accessed.

In another embodiment of the invention, each of the first access information and the second access information correspond to an identifier received by the accessing unit and/or by the sensing unit.

In yet another embodiment of the invention, the first access information and the second access information are correlated with each other when the time stamp associated with the first access information and the time stamp associated with the second access information fall within a pre-defined time limit, wherein the first access information and the second access information are not correlated with each other when the time stamp associated with the first access information and the time stamp associated with the second access information do not fall within a pre-defined time limit.

In another embodiment of the invention, the message is a confirmation message transmitted by the server to the accessing unit and/or the sensing unit when the first access information and the second access information are correlated with each other, wherein the message is an alarm message transmitted by the server to the accessing unit and/or the sensing unit when the first access information and the second access information are not correlated with each other.

In still another embodiment of the invention, the sensing unit is adapted to trigger an alarm or provide a notification to a central service when the sensing unit receive the alarm message from the server, wherein the sensing unit is adapted to transmit a signal to a camera to initiate recording when the sensing unit receives the alarm message from the server.

In another different embodiment of the invention, a computer readable medium is disclosed for providing security to a premises. The computer readable medium comprises one or more processors and a memory is coupled to the one or more processors, the memory stores instructions executed by the one or more processors. The one or more processors are configured to receive first access information from an accessing unit associated with a premises on accessing the premises by a first user and second access information from a sensing unit associated with the premises on sensing access of the premises by a second user. The one or more processors are further configured to determine correlation between the first access information and the second access information and transmit a message based on the correlation.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which taken in conjunction with the annexed drawings, discloses exemplary embodiments of the invention.

DETAILED DESCRIPTION OF THE INVENTION

Figure 1:
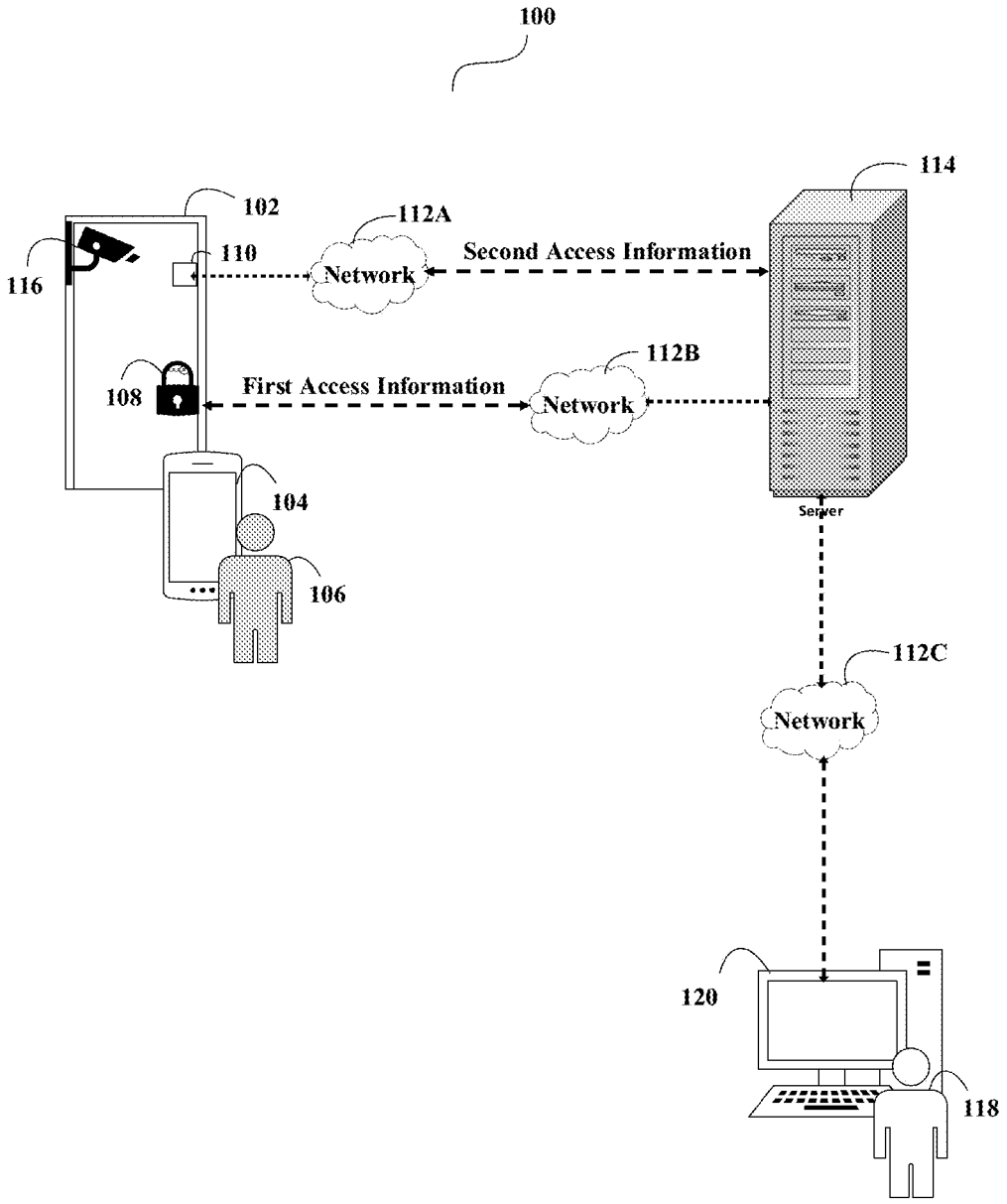
FIG. 1 depicts an exemplary system architecture according to an exemplary embodiment of the invention.

Described herein is the technology with a system and a method for providing enhanced security to a premises. An accessing unit and a sensing unit may be associated with an entrance of a premises for accessing the premises by a user. When a first user reaches the premises, the user may provide credentials to the accessing unit and the accessing unit may validate the credentials for providing access to the first user inside the premises. The accessing unit may generate first access information when the accessing unit provides access to the first user inside the premises. The first access information may be transmitted to a server through a network. The sensing unit senses the accessing of the premises by the first user as an independent event. The sensing unit generates second access information when the sensing unit provides access to the first user inside the premises as a separate user (hereinafter "second user"). The second access information may be transmitted to the server through a network. The server may determine correlation between the first access information and the second access information. Accordingly, the server may generate and transmit a message based on the correlation. In an exemplary embodiment, the first user and the second user are the same users if the first access information and the second access information are correlated with each other. In another exemplary embodiment, the first user and the second user are different users if the first access information and the second access information are not correlated.

As used herein, the premises may be a storage unit, a warehouse, a godown, a room, a building, a home, a bank, an office, a mall, a college, a hospital, and/or any such premises where one or more items may be kept and where the sensing unit and accessing unit can be installed. Also, the premises may have an entrance where the accessing unit and the sensing unit may be installed. In an exemplary embodiment, the entrance of the premises is a roll-up door. In an exemplary embodiment, the entrance may be a door of the premises.

As used herein, the accessing unit may be installed at an entrance of a premises and can be opened or closed by a user. In an exemplary embodiment, the accessing unit may be a lock. The accessing unit may comprise, but is not limited to, a transmitter, a receiver, a generation unit, a validation unit, a processor and/or memory. The accessing unit may have capability to interact with a server using a network.

As used herein, the sensing unit may be one or more sensors that can be installed at an entrance of a premises and can sense accessing of the premises by a user. In an exemplary embodiment, the sensing unit may be a door sensor, a surface contact sensor, a recessed contact sensor, a vanishing sensor, a vented window sensor, a passive infrared sensor, ultrasonic sensors, a thermal sensor, a microwave detector, a pyroelectric human presence sensor, an infra-red sensor or any such sensor that can sense accessing of the premises by the user. The sensing unit may comprise, but is not limited to, a transmitter, a receiver, a generation unit, a processor and/or memory. The sensing unit may have capability to interact with a server, a camera and/or a central service through a network.

As used herein, the server has processing capabilities as disclosed further in the specification. The server may be a cloud storage, a remote database, or any such storage known in the art.

As used herein, the network may refer to a wired network, a mesh network, a cellular network (such as Global System for Mobile (GSM) network, a Long-Term Evolution (LTE) network, a code-division multiple access (CDMA) network, a narrow-band internet of thing (NB-IoT) technique or category M1 technique)), a WiFi network, a ZigBee network or any such network/technique that is known in the art.

FIG. 1 depicts an exemplary system architecture 100 according to an exemplary embodiment of the invention. As can be seen, a premises 102 may have an accessing unit 108 and a sensing unit 110. When a first user 106 reaches the premises 102, the first user 106 may provide credentials to the accessing unit 108 for accessing the premises 102. For this, the first user 106 may input the credentials in an interface of the accessing unit 108 to access the premises 102. Alternatively, the first user 106 may input the credentials to the accessing unit 108 through a user device 104. For an instance, the first user 106 may bring the user device 104 near the accessing unit 108. The accessing unit 108 may read the credentials from the user device 104 using radio frequency identification (RFID), near-field communication, bluetooth or any such short-range technology. In order to use the user device 104 to input the credentials to the accessing unit 108, both the user device 104 and the accessing unit 108 should be enabled with such technology. As used herein, the credentials may be a personal identification number (PIN), a passcode, a biometric input, an RFID tag, a smart label, a unique identifier, a digital/mobile credential, a digital certificate, or any such credentials that is well known in the art.

When the accessing unit 108 receives the credentials, the accessing unit 108 may validate the credentials inputted by the first user 106. For this, the accessing unit 108 may compare the credentials inputted by the first user 106 with a pre-stored credentials stored in the accessing unit 108. When the credentials inputted by the first user 106 match with the pre-stored credentials, the accessing unit 108 may provide access of the premises 102 to the first user 106. When the credentials inputted by the first user 106 do not match with the pre-stored credentials, the accessing unit 108 may not provide access of the premises 102 to the first user 106. In case the accessing unit 108 provides access of the premises 102 to the first user 106, the accessing unit 108 may generate first access information. The first access information may correspond to a time-stamp when the first user 106 has accessed the premises 102, an identifier of the accessing unit 108 being opened by the first user 106 to access the premises 102 and/or an identifier of the user device 104 received by the accessing unit when the first user 106 has provided credentials from the user device 104 to the accessing unit 108. Then, the accessing unit 108 may transmit the first access information to a server 114 through a network 112B.

On the entry of the first user 106 inside the premises 102, the sensing unit 110 may sense such accessing of the premises 102 independently regardless of the access provided by the accessing unit 108 to the first user 106. The sensing unit 110 may sense the access of the premises 102 by the first user 106 as a separate event and considers the first user 106 as a different user (hereinafter "second user"). In such a scenario, the sensing unit 110 may generate second access information. The second access information may correspond to a time-stamp when the second user 106 has accessed the premises 102 and/or an identifier of the sensing unit 110 associated with the premises 102. Then, the sensing unit 110 may transmit the second access information to the server 114 through a network 112A. As the first access information is generated and transmitted by the accessing unit 108 and the second access information is generated and transmitted by the sensing unit 110, thus, the first access information and the second access information are derived independently by the accessing unit 108 and the sensing unit 110, respectively.

In addition, the first access information and the second access information may also comprise an identifier associated with the user device 104. Such an identifier of the user device 104 may be an international mobile subscriber identity (IMSI), a media access control address (MAC) or any such unique identifier associated with the user device 104. When the first/second user 106 accesses the premises 102 through the user device 104, the accessing unit 108 and the sensing unit 110 may sense such accessing of the premises 102 and may transmit the identifier associated with the user device 104 to the server 114. Alternatively, when the first/second user 106 accesses the premises 102 through the user device 104, the user device 104 may transmit the identifier associated with the user device 104 to the server 114 through a network. Such a network, from which the user device 104 transmits the identifier to the server 114, may be an independent network and may be different from the network 112A and the network 112B.

The server 114 receives the first access information from the accessing unit 108 through the network 112B or from the user device 104 through a network (as explained above) and the second access information from the sensing unit 110 through the network 112A. The server 114 may determine correlation between the first access information and the second access information. In particular, the server 114 determines the first access information and the second access information are correlated with each other if a time stamp associated with the first access information and a time stamp associated with the second access information fall within a pre-defined time limit. The server 114 determines that the first access information and the second access information are not correlated with each other if a time stamp associated with the first access information and a time stamp associated with the second access information do not fall within the pre-defined time limit. Moreover, in order to determine that the first access information and the second access information are correlated with each other, the server 114 may also determine whether the accessing unit 108 and the sensing unit 110 are associated with the same premises 102 and thereby paired/connected with each other. Alternatively, if the accessing unit 108 and the sensing unit 110 are associated with different premises 102 and are not paired/ connected with each other, then the server 114 may not determine the correlation between the first access information and the second access information. This would ensure that the correlation between the first access information and the second access information is determined correctly. As used herein, the pre-defined time limit may be configured by an owner of the premises 102 or by any such person who wishes to secure the premises 102.

In addition, the server 114 may determine that the first user and the second user are the same users if the first access information and the second access information are correlated with each other. In other words, the server may determine that the first access information and the second access information are coming from the same users. The server 114 may also determine that the first user and the second user are different users if the first access information and the second access information are not correlated with each other. In an another exemplary embodiment, when the server 114 determines the correlation between the first access information and the second access information, the server 114 also checks if the identifier associated with the user device 104 received from the accessing unit 108 and the sensing unit 110 are same or not. In case, the identifier associated with the user device 104 are same, the server 114 determines that the first access information and the second access information are correlated with each other. Otherwise, if the identifier associated with the user device 104 are not same, the server 114 determines that the first access information and the second access information are not correlated with each other. In a different exemplary embodiment, the server 114 may consider the pre-defined time limit and the identifier associated with the user device 104 to determine if the first access information and the second access information are correlated with each other.

Consider an exemplary Table 1 below showing exemplary first access information (i.e. an identifier of the accessing unit 108, most recent time stamp from the accessing unit 108, date of most recent time stamp from the accessing unit 108), exemplary second access information (i.e. an identifier of the sensing unit 110, most recent time stamp from the sensing unit 110, date of most recent time stamp from the sensing unit 110) and determination of correlation between the first access information and the second access information. The correlation between the first access information and the second access information can be only determined when both of the first access information and the second access information received from the accessing unit 108 and the sensing unit 110 are associated with the same premises 102. Thereby, the accessing unit 108 and the sensing unit 110 associated with the same premises 102 are communicably coupled or paired with each other. And, when the first access information received from the accessing unit 108 which is associated with one premises and the second access information received from the sensing unit 110 which is associated with other premises, then the accessing unit 108 and the sensing unit 110 are associated with two different premises and are not communicably coupled or paired with each other. Thereby, in this situation, the first access information and the second access information would not be correlation with each other. This would help in determining the correct correlation between the first access information and the second access information. Also help in preventing the server 114 from generating false alarms to alert a security personnel of the premises 102.

TABLE 1

| First Access Information | | | Second Access Information | | | Correlation between first access information and second access information |
|---|---|---|---|---|---|---|
| Accessing Unit Identifier | Most Recent Time Stamp from the accessing unit | Date of Most Recent Time Stamp from the accessing unit | Sensing Unit Identifier | Most Recent Time Stamp from the sensing unit | Date of Most Recent Time Stamp from the sensing unit | |
| A108P102 | 10:30 AM | 1 Dec. 2019 | S110P102 | 10:32 AM | 1 Dec. 2019 | Correlated |
| A108P102 | 10:30 AM | 3 Dec. 2019 | S110P102 | 09:10 PM | 3 Dec. 2019 | Not Correlated |
| A108P102 | 11:00 PM | 5 Dec. 2019 | S110P102 | 11:18 PM | 5 Dec. 2019 | Correlated |
| A108P102 | 08:00 AM | 5 Dec. 2019 | S110P102 | 10:20 PM | 7 Dec. 2019 | Not Correlated |

As shown in exemplary Table 1, the accessing unit 108 with an identifier of A108P102 has most recent time stamp of 10:30 AM on 1 Dec. 2019 and the sensing unit 110 with an identifier of S110P102 has most recent time stamp of 10:32 AM on 1 Dec. 2019. Considering that the pre-defined time limit is 5 minutes. Then, in such a case, the most recent time stamp (i.e. 10:30 AM on 1 Dec. 2019) from the accessing unit 108 and the most recent time stamp (i.e. 10:32 AM on 1 Dec. 2019) from the sensing unit 110 fall within the pre-defined time limit (i.e. 5 minutes). Thus, in this case, the first access information and the second access information are correlated with each other. Thereby, the first user & the second user are same users. Taking the next example, the accessing unit 108 with an identifier of A108P102 is accessed at 10:30 AM on 3 Dec. 2019 and the sensing unit 110 is accessed at 09:10 PM on 3 Dec. 2019. Here, the most recent time stamp (i.e. 10:30 AM on 3 Dec. 2019) from the accessing unit 108 and the most recent time stamp (i.e. 09:10 PM on 3 Dec. 2019) from the sensing unit 110 do not fall within the pre-defined time limit (i.e. 5 minutes). Thus, in this case, the first access information and the second access information are not correlated with each other. Thereby, the first user & the second user are different users. Similarly, when the accessing unit 108 with an identifier of A108P102 is accessed at 11:00 PM on 5 Dec. 2019 and the sensing unit 110 is accessed at 11:18 PM on 5 Dec. 2019, the first access information and the second access information are correlated with each other. Thereby, the first user & the second user are same users. In the last case, the first access information and the second access information are not correlated with each other as the accessing unit 108 and the sensing unit 110 are accessed on different dates. Thereby, in this last case, the first user & the second user are different users.

In an exemplary embodiment, when the server 114 determines that the first access information and the second access information are correlated with each other, the server 114 may transmit a message (i.e. a confirmation message) to the accessing unit 108 through the network 112B, to the sensing unit 110 through the network 112A and/or to a device 120 (of an owner or security personnel 118 of the premises 102) through a network 112C. Such a confirmation message indicates that the first user and/or the second user are the same users and an authorized user who is accessing the premises 102. In a different exemplary embodiment, when the server 114 determines that the first access information and the second access information are not correlated with each other, the server 114 may transmit a message (i.e. an alarm message) to the accessing unit 108 through the network 112B, to the sensing unit 110 through the network 112A and/or to the device 120 of the owner or security personnel 118 of the premises 102 through a network 112C. Such an alarm message indicates that the first user and/or the second user are different users and may not be authorized to access the premises 102.

Moreover, when the sensing unit 110 receives the alarm message from the server 114, the sensing unit 110 may trigger an alarm to alert the security personnel 118 of the premises 102 regarding unauthorized access of the premises 102. Also, the sensing unit 110 may further provide a notification to a central service (such as building management team, security team etc.) of the premises 102 to inform about the unauthorized access of the premises 102 by a first/second user. The sensing unit 110 may transmit a signal to a nearby camera 116 installed in the premises 102 to initiate recording when the sensing unit 110 receives the alarm message from the server 114. In this way, the video recording may be paired with the unauthorized access of the premises 102 determined by the server 114. Alternatively, the camera 116 may be continuously recording the activities in the premises 102 which would capture the unauthorized access of the premises 102. This embodiment of the invention provides a technical advantage of providing security to the premises 102 and informing the owner/security personnel 118 of the premises 102 regarding the unauthorized access of the premises 102.

The present invention encompasses the server 114 to receive an indication from the camera 116, the accessing unit 108, the sensing unit 110 and/or the user device 104 when the first user and/or the second user exits the premises 102. In an exemplary first embodiment, the camera 116 may use techniques (such as object movement or identification etc.) to detect if the first user and/or the second user has exited the premises 102. Alternatively, the camera 116 may record when the first user and/or the second user exits the premises 102 and may transmit the recording to the server 114 to determine if the first user and/or the second user has exited the premises 102. In an exemplary second embodiment, the accessing unit 108 may determine that the first user and/or the second user has exited the premises 102 based on a close/locked status of the accessing unit 108. In an exemplary third embodiment, the sensing unit 110 may determine that the first user and/or the second user has exited the premises 102 when the sensing unit 110 does not sense accessing of the premises 102 by the first user and/or the second user. In an exemplary fourth embodiment, the user device 104 may transmit an indication to the server 114 by selecting an exit option provided in an application stored in the user device 104. Alternatively, the user device 104 may transmit the indication to the server 114 based on a location of the user device 104 by using a global positioning system (i.e. GPS) of the user device 104 to determine if the first user and/or the second user has exited the premises 102. The user device 104 may create also a virtual geofence around the premises 102 and the user device 104 is determined to have left the premises 102 when outside the geofence. When the server 114 receives the indication, the server 114 may provide a command to the accessing unit 108 and the sensing unit 110 for determining correlation when a new user accesses the premises 102. Such an embodiment of the invention would be helpful and useful when a legitimate user has entered the premises 102, then leaves the premises 102 and if the pre-defined time limit is too long. In such a situation if an indication that the user has left the site does not exist, an unauthorized person/thief may come after the legitimate user and an alarm may not be triggered to alert the security personnel 118 regarding unauthorized access as the pre-defined time limit is too long. Through the usage of this embodiment, the server 114 would always have knowledge (i.e. indication) regarding the exit of the legitimate user from the premises 102 and then the server 114 may communicate with the accessing unit 108 and the sensing unit 110 to determine correlation when any new user accesses the premises 102 after the legitimate user exits the premises 102. This embodiment can handle the situation of the long pre-defined time limit without creating a security vulnerability.

The present invention further encompasses the accessing unit 108 and the sensing unit 110 to communicate with each other. By doing this, the second access information generated from the sensing unit 110 may also reside inside a memory of the accessing unit 108 and the accessing unit 108 may verify the first access information and the second access information to determine whether these two information are correlated or not. Also, the sensing unit 110 may also perform such operations. Further, the sensing unit 110 may also verify the second access information by using light detectors/noise detectors when an event is triggered. Further, the first access information may also be verified with one or more neighborhood accessing units and may determine correlation to trigger access permissions. Moreover, when the sensing unit 110 gets damaged or if there is no response from the sensing unit 110, the first access information may be verified with the one or more neighborhood accessing units through a mesh network and may accordingly, grant permission to access the premises 102.

Figure 2:
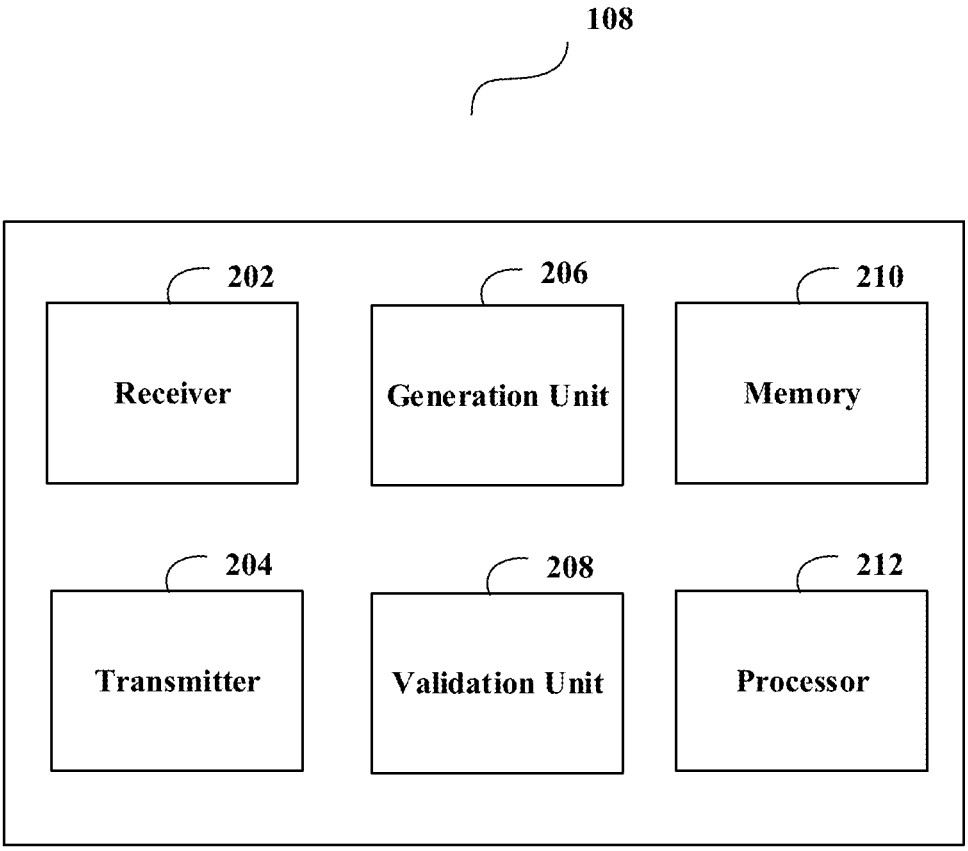
FIG. 2 depicts block diagram of different components of an exemplary accessing unit according to an exemplary embodiment of the invention.

FIG. 2 depicts a block diagram of different components of an exemplary accessing unit 108 according to an exemplary embodiment of the invention. The accessing unit 108 may comprise of, but is not limited to, a receiver 202, a transmitter 204, a generation unit 206, a validation unit 208, a memory 210 and/or a processor 212. The receiver 202 may be adapted to receive credentials from a first user to access a premises 102 as explained in FIG. 1 above. In an exemplary embodiment, the receiver 202 may be an interface or a reader. The receiver 202 may communicate the validation unit 208. The validation unit 208 may be adapted to validate the credentials inputted by the first user and may provide access of the premises 102 to the first user as explained in FIG. 1 above. The validation unit 208 may communicate to the generation unit 206 about the validation of the credentials. When the credentials inputted by the first user are valid, the generation unit 206 may be adapted to generate first access information. The generation unit 206 may communicate the first access information to the transmitter 204. The transmitter 204 may be adapted to transmit the first access information to a server 114 through a network 112B. The receiver 202 may be adapted to receive a message from the server 114 through a network 112B based on correlation as discussed above. The memory 210 may be further adapted to store the first access information and/or identifier of the accessing unit 108.

Moreover, the receiver 202, the transmitter 204, the generation unit 206, the validation unit 208, and/or the memory 210 may be communicably coupled with the processor 212. The different units described herein are exemplary. The invention may be performed using one or more units. For example, the tasks executed by the receiver 202, the transmitter 204, the generation unit 206, the validation unit 208, the memory 210 and/or the processor 212 may be performed by a single unit. Alternatively, more number of units as described herein may be used to perform the present invention.

Figure 3:
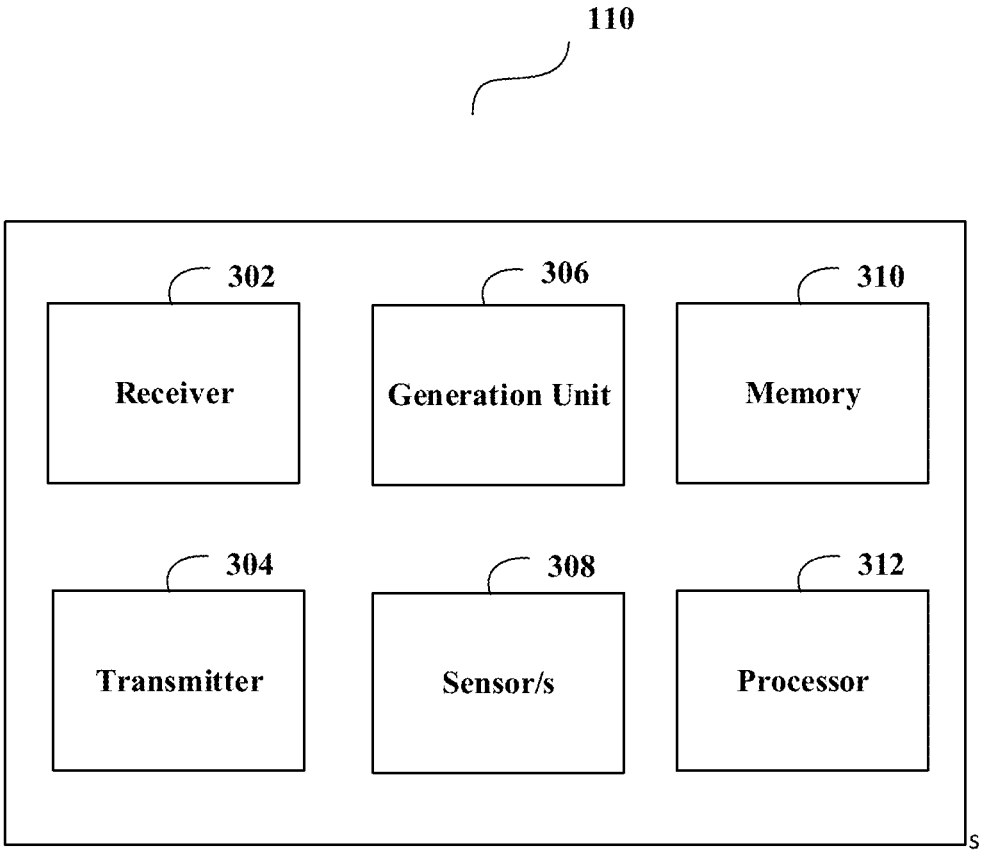
FIG. 3 depicts a block diagram of different components of an exemplary sensing unit according to an exemplary embodiment of the invention.

FIG. 3 depicts a block diagram of different components of an exemplary sensing unit 110 according to an exemplary embodiment of the invention. The sensing unit 110 may comprise of, but is not limited to, a receiver 302, a transmitter 304, a generation unit 306, a sensor/s 308, a memory 310 and/or a processor 312. The sensor/s 308 may be adapted to sense accessing of a premises 102 by a second user as described above. The sensor/s 308 communicate to the generation unit 306 about sensing access of the premises 102 by the second user. The generation unit 306 may be adapted to generate second access information. The generation unit 306 may communicate the second access information to the transmitter 304. The transmitter 304 may be adapted to transmit the second access information to a server 114 through a network 112A. The memory 310 may be adapted to store the second access information and/or identifier of the sensing unit 110. The receiver 302 may be adapted to receive a message from the server 114 through the network 112A based on correlation as discussed above.

Moreover, the receiver 302, the transmitter 304, the generation unit 306, the sensor/s 308, and/or the memory 310 may be communicably coupled with the processor 312. The different units described herein are exemplary. The invention may be performed using one or more units. For example, the tasks executed by the receiver 302, the transmitter 304, the generation unit 306, the sensor/s 308, the memory 310 and/or the processor 312 may be performed by a single unit. Alternatively, more number of units as described herein may be used to perform the present invention.

Figure 4:
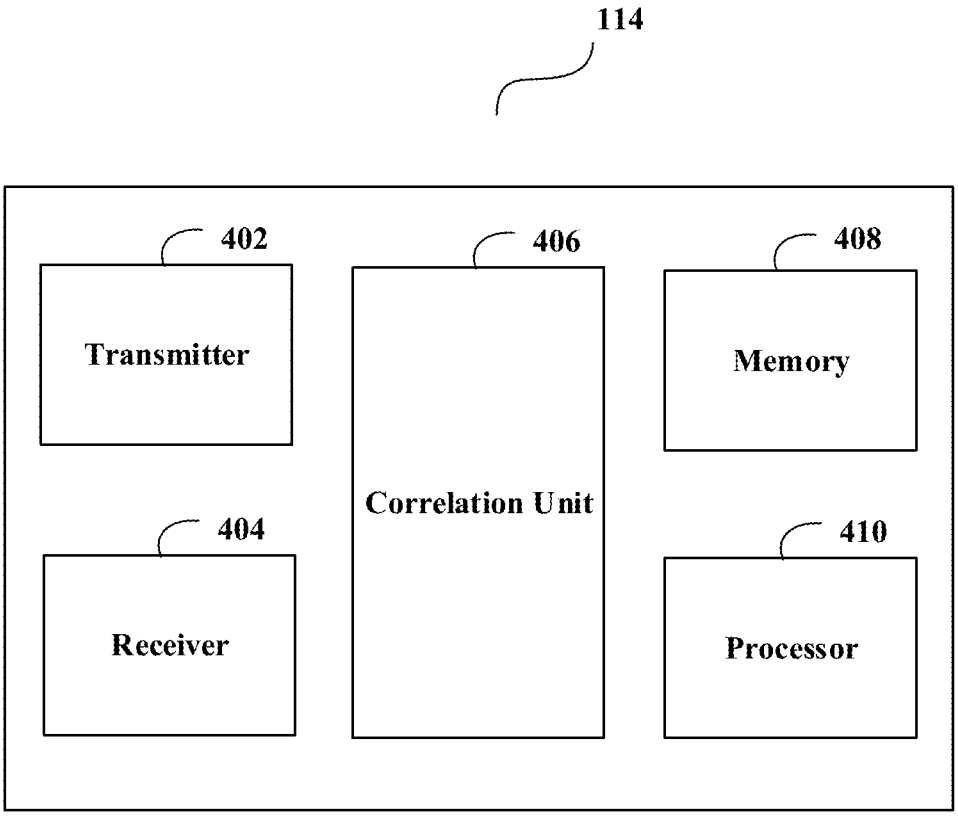
FIG. 4 depicts block diagram of different components of an exemplary server according to an exemplary embodiment of the invention.

FIG. 4 depicts a block diagram of different components of an exemplary server 114 according to an exemplary embodiment of the invention. The server 114 may comprise of, but is not limited to, a transmitter 402, a receiver 404, a correlation unit 406, a memory 408 and/or a processor 410. The receiver 404 may be adapted to receive first access information from an accessing unit 108 through a network 112B and second access information from a sensing unit 110 through a network 112A. The correlation unit 406 may be adapted to determine correlation between the first access information and the second access information as explained in FIG. 1 above. The transmitter 402 may be adapted to transmit a message (i.e. a confirmation message) to the accessing unit 108 indicating that a first user and/or a second user are the same users and an authorized user for accessing the premises 102 if the first access information and the second access information are correlated. The transmitter 402 may also be adapted to transmit a message (i.e. an alarm message) to the sensing unit 110 indicating that the first user and/or the second user are different users and may not be an authorized user who is accessing the premises 102 if the first access information and the second access information are not correlated. The memory 408 may be adapted to store the correlation between the first access information and the second access information, an identifier of the sensing unit 110, and/or an identifier of the accessing unit 108.

Moreover, the transmitter 402, the receiver 404, the correlation unit 406, and/or the memory 408 may be communicably coupled with the processor 410. The different units described herein are exemplary. The invention may be performed using one or more units. For example, the tasks executed by the transmitter 402, the receiver 404, the correlation unit 406, the memory 408 and/or processor 410 may be performed by a single unit. Alternatively, more number of units as described herein may be used to perform the present invention.

Figure 5:
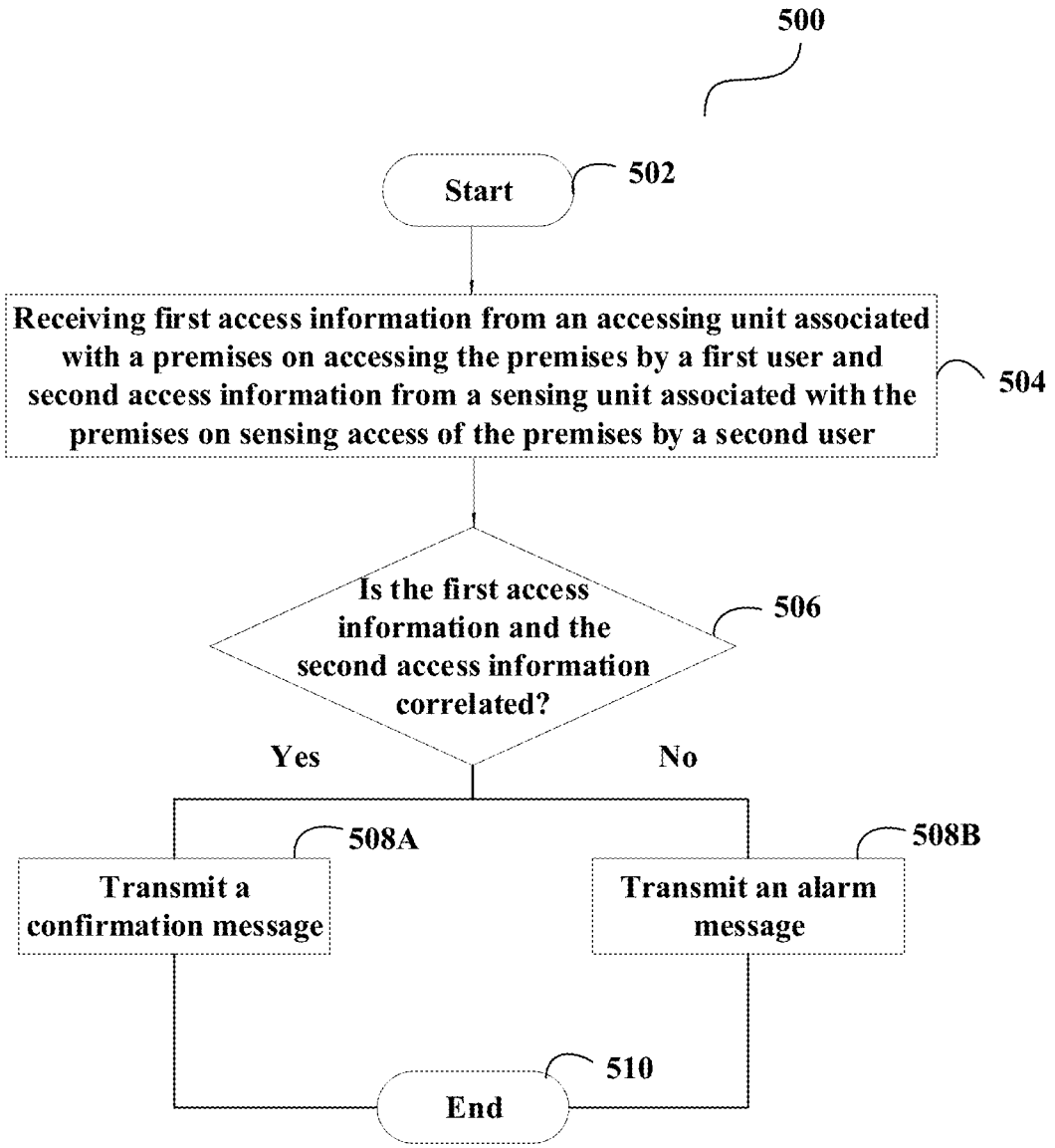
FIG. 5 depicts an exemplary flowchart illustrating a method to perform the invention according to an exemplary embodiment of the invention Corresponding reference numerals indicate corresponding parts throughout the drawings.

FIG. 5 depicts a flowchart outlining the features of the invention in an exemplary embodiment of the invention. The method flowchart 500 describes a method being for providing security to a premises. The method flowchart 500 starts at step 502.

At step 504, a server 114 may receive first access information from an accessing unit 108 associated with a premises 102 through a network 112B on accessing the premises by a first user and second access information from a sensing unit 110 associated with the premises 102 through a network 112A on sensing access of the premises by a second user.

At step 506, the server 114 may determine correlation between the first access information and the second access information as explained in FIG. 1 above. If the first access information and the second access information are correlated with each other, then the method 500 moves to step 508A. If the first access information and the second access information are not correlated with each other, then the method 500 moves to step 508B.

At step 508A, the server 114 may transmit a message (i.e. a confirmation message) to the accessing unit 108 indicating that a first user and/or a second user are the same users and an authorized user who is accessing the premises 102. And, at step 508B, the server 114 may transmit a message (i.e. an alarm message) to the sensing unit 110 indicating that the first user and/or the second user are different users and may not be an authorized user who is accessing the premises 102. Then, the method flowchart 500 may end at 510.

The present invention is applicable in various industries/fields such as, but not limited to, banking industry, hospitality industry, residential industry, storage industry, building/construction industry, offices, warehouses, godowns, universities, hospitals, colleges, homes and any such industry/field that is well known in the art and where the accessing unit 108 and the sensing unit 110 may be installed at an entrance of the premises 102.

The embodiments of the invention discussed herein are exemplary and various modification and alterations to a person skilled in the art are within the scope of the invention.

In one embodiment of the invention, the invention can be operated using the one or more computer readable devices. The one or more computer readable devices can be associated with a server 114. A computer readable medium comprises one or more processors and a memory coupled to the one or more processors, the memory stores instructions executed by the one or more processors. The one or more processors configured to receive first access information from an accessing unit 108 associated with a premises 102 on accessing the premises 102 by a first user and second access information from a sensing unit 110 associated with the premises 102 on sensing access of the premises 102 by a second user. The one or more processors configured to determine correlation between the first access information and the second access information and transmit a message based on the correlation.

Exemplary computer readable media includes flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware and exclude carrier waves and propagated signals. Computer storage media for purposes of this invention are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

Although described in connection with an exemplary computing system environment, examples of the invention are capable of implementation with numerous other general purpose or special purpose computing system environments, configurations, or devices.

Examples of the invention may be described in the general context of computer-executable instructions, such as program modules, executed by one or more computers or other devices in software, firmware, hardware, or a combination thereof. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the Figures/Tables and described herein. Other examples of the invention may include different computer-executable instructions or components having more or less functionality than illustrated and described herein. Aspects of the invention transform a general-purpose computer into a special-purpose computing device when configured to execute the instructions described herein.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor may also be implemented as a combination of computing processing units.

In the subject specification, terms such as "data store," "data storage," "database," "cache," and substantially any other information storage component relevant to operation and functionality of a component, refer to "memory components," or entities embodied in a "memory" or components comprising the memory. It will be appreciated that the memory components, or computer-readable storage media, described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C".

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A system comprising:

an accessing unit associated with a premises, the accessing unit comprising:

a validation unit adapted to validate credentials of a first user for providing access inside the premises to the first user; and a transmitter adapted to transmit first access information to a server based on the validation of the credentials;

a sensing unit associated with the premises, the sensing unit adapted to sense access of the premises by a second user and adapted to transmit second access information to the server based on the sensing; and the server comprising:

a receiver adapted to receive the first access information from the accessing unit associated with the premises and the second access information from the sensing unit associated with the premises;

a correlation unit adapted to determine correlation between the first access information and the second access information; and a transmitter adapted to transmit a message based on the correlation;

wherein each of the first access information and the second access information correspond to a time stamp when the premises is accessed;

wherein the first access information and the second access information are correlated with each other when the time stamp associated with the first access information and the time stamp associated with the second access information fall within a pre-defined time limit, wherein the first access information and the second access information are not correlated with each other when the time stamp associated with the first access information and the time stamp associated with the second access information do not fall within a pre-defined time limit;

wherein the message is a confirmation message transmitted by the server to the accessing unit and/or the sensing unit when the first access information and the second access information are correlated with each other, wherein the message is an alarm message transmitted by the server to the accessing unit and/or the sensing unit when the first access information and the second access information are not correlated with each other.

2. The system of claim 1, wherein the first user and the second user are the same users if the first access information and the second access information are correlated, wherein the first user and the second user are different users if the first access information and the second access information are not correlated.

3. The system of claim 1, wherein the first access information and the second access information are derived independently.

4. The system of claim 1, wherein each of the first access information and the second access information correspond to a time stamp when the premises is accessed.

5. The system of claim 4, wherein the first access information and the second access information are correlated with each other when the time stamp associated with the first access information and the time stamp associated with the second access information fall within a pre-defined time limit, wherein the first access information and the second access information are not correlated with each other when the time stamp associated with the first access information and the time stamp associated with the second access information do not fall within a pre-defined time limit.

6. The system of claim 1, wherein each of the first access information and the second access information correspond to an identifier received by the accessing unit and/or by the sensing unit.

7. The system of claim 1, wherein the accessing unit receives the credentials from the first user or a user device of the first user.

8. The system of claim 1, wherein the server receives an indication from a camera, the accessing unit, the sensing unit and/or a user device when the first user and/or the second user exits the premises, wherein after receiving the indication, the server provides a command to the accessing unit and the sensing unit for determining correlation when a new user accesses the premises.

9. The system of claim 1, wherein the accessing unit transmits the first access information and/or the sensing unit transmits the second access information to the server using a Wi-Fi network, a mesh network, a Bluetooth network, or a cellular network.

10. The system of claim 1, wherein the message is a confirmation message transmitted by the server to the accessing unit and/or the sensing unit when the first access information and the second access information are correlated with each other, wherein the message is an alarm message transmitted by the server to the accessing unit and/or the sensing unit when the first access information and the second access information are not correlated with each other.

11. The system of claim 10, wherein the sensing unit is adapted to trigger an alarm or provide a notification to a central service when the sensing unit receives the alarm message from the server, wherein the sensing unit is adapted to transmit a signal to a camera to initiate recording when the sensing unit receives the alarm message from the server.

12. A method comprising:

receiving first access information from an accessing unit associated with a premises on accessing the premises by a first user and second access information from a sensing unit associated with the premises on sensing access of the premises by a second user;

determining correlation between the first access information and the second access information; and transmitting a message based on the correlation;

wherein each of the first access information and the second access information correspond to a time stamp when the premises is accessed;

wherein the first access information and the second access information are correlated with each other when the time stamp associated with the first access information and the time stamp associated with the second access information fall within a pre-defined time limit, wherein the first access information and the second access information are not correlated with each other when the time stamp associated with the first access information and the time stamp associated with the second access information do not fall within a pre-defined time limit;

wherein the message is a confirmation message transmitted by the server to the accessing unit and/or the sensing unit when the first access information and the second access information are correlated with each other, wherein the message is an alarm message transmitted by the server to the accessing unit and/or the sensing unit when the first access information and the second access information are not correlated with each other.

13. The method of claim 12, wherein the first user and the second user are the same users if the first access information and the second access information are correlated, wherein the first user and the second user are different users if the first access information and the second access information are not correlated.

14. The method of claim 12, wherein the first access information and the second access information are derived independently.

15. The method of claim 12, wherein each of the first access information and the second access information correspond to a time stamp when the premises is accessed.

16. The method of claim 15, wherein the first access information and the second access information are correlated with each other when the time stamp associated with the first access information and the time stamp associated with the second access information fall within a pre-defined time limit, wherein the first access information and the second access information are not correlated with each other when the time stamp associated with the first access information and the time stamp associated with the second access information do not fall within a pre-defined time limit.

17. The method of claim 12, wherein each of the first access information and the second access information correspond to an identifier received by the accessing unit and/or by the sensing unit.

18. The method of claim 12, wherein the message is a confirmation message transmitted by the server to the accessing unit and/or the sensing unit when the first access information and the second access information are correlated with each other, wherein the message is an alarm message transmitted by the server to the accessing unit and/or the sensing unit when the first access information and the second access information are not correlated with each other.

19. The method of claim 18, wherein the sensing unit is adapted to trigger an alarm or provide a notification to a central service when the sensing unit receives the alarm message from the server, wherein the sensing unit is adapted to transmit a signal to a camera to initiate recording when the sensing unit receives the alarm message from the server.

20. A non-transitory computer readable medium comprising one or more processors and a memory coupled to the one or more processors, the memory storing instructions executed by the one or more processors, the one or more processors configured to:

receive first access information from an accessing unit associated with a premises on accessing the premises by a first user and second access information from a sensing unit associated with the premises on sensing access of the premises by a second user;

determine correlation between the first access information and the second access information; and transmit a message based on the correlation;

wherein each of the first access information and the second access information correspond to a time stamp when the premises is accessed;

wherein the first access information and the second access information are correlated with each other when the time stamp associated with the first access information and the time stamp associated with the second access information fall within a pre-defined time limit, wherein the first access information and the second access information are not correlated with each other when the time stamp associated with the first access information and the time stamp associated with the second access information do not fall within a pre-defined time limit;

wherein the message is a confirmation message transmitted by the server to the accessing unit and/or the sensing unit when the first access information and the second access information are correlated with each other, wherein the message is an alarm message transmitted by the server to the accessing unit and/or the sensing unit when the first access information and the second access information are not correlated with each other.

* * * * *